US007270719B2

(12) United States Patent
Berglund

(10) Patent No.: US 7,270,719 B2
(45) **Date of Patent: *Sep. 18, 2007**

(54) METHOD FOR MANUFACTURING SURFACE HARDENED STAINLESS STEEL WITH IMPROVED WEAR RESISTANCE AND LOW STATIC FRICTION PROPERTIES

(75) Inventor: Göran Berglund, Sandviken (SE)

(73) Assignee: Sandvik Intellectual Property AB, Sandviken (SE)

( * ) Notice: Subject to any disclaimer, the term of this patent is extended or adjusted under 35 U.S.C. 154(b) by 87 days.

This patent is subject to a terminal disclaimer.

(21) Appl. No.: 10/755,349

(22) Filed: Jan. 13, 2004

(65) Prior Publication Data

US 2004/0197581 A1 Oct. 7, 2004

(30) Foreign Application Priority Data

Jan. 13, 2003 (SE) ..... 0300074

(51) Int. Cl.

| | |
|---|---|
| ***C23C 14/02*** | (2006.01) |
| ***C23C 14/06*** | (2006.01) |
| ***C23C 14/22*** | (2006.01) |
| ***C23C 4/04*** | (2006.01) |
| ***C23C 30/30*** | (2006.01) |

(52) U.S. Cl. ..... 148/225; 427/249.18; 427/249.7; 427/255.394

(58) Field of Classification Search ..... 428/457, 428/698, 908.8; 148/225, 230; 427/249.1, 427/249.7, 249.18, 255.394, 902
See application file for complete search history.

(56) References Cited

U.S. PATENT DOCUMENTS

| | | | | |
|---|---|---|---|---|
| 3,988,955 | A | 11/1976 | Engle et al. | |
| 5,197,783 | A | 3/1993 | Theimer et al. | |
| H1210 | H * | 7/1993 | Jansen | |
| 5,632,826 | A | 5/1997 | Hultin-Stigenberg et al. | |
| 5,707,748 | A | 1/1998 | Bergmann | |
| 5,830,531 | A | 11/1998 | Bergmann | |
| 6,238,490 | B1 * | 5/2001 | Bell et al. | 148/225 |
| 6,475,307 | B1 * | 11/2002 | Nystrom et al. | 148/326 |
| 2003/0195074 | A1 | 10/2003 | Kaga et al. | |
| 2004/0173288 | A1 | 9/2004 | Berglund | |
| 2006/0102253 | A1 | 5/2006 | Berglund | |

FOREIGN PATENT DOCUMENTS

| | | |
|---|---|---|
| GB | 2 364 530 | 1/2002 |
| JP | 09-094911 | 4/1997 |
| WO | WO93/07303 | 4/1993 |
| WO | WO95/09930 | 4/1995 |
| WO | WO99/55929 | 11/1999 |
| WO | WO 01/14601 A1 | 3/2001 |
| WO | WO 01/36699 A1 | 5/2001 |
| WO | WO 01/79585 A1 | 10/2001 |

OTHER PUBLICATIONS

S. J. Harris et al., "A diamond-like carbon film for wear protection of steel", *Surface and Coatings Technology*, 62, (1993) 550-557.
W. König et al., "PVD- and CVD-beschichtete Hartmetalle im Leistungsvergleich", *Proceedings of the 13th International Plansee Seminar, Eds. H. Bildstein and R. Eck, Metallwerk Plansee, Reutte* (1993), vol. 3, pp. 1-15.
G. Berglund, U.S. Appl. No. 11/755,347, filed Jan. 13, 2004, entitled "Surface Modified Precipitation Hardened Stainless Steel".

* cited by examiner

*Primary Examiner*—Michael E. LaVilla
(74) *Attorney, Agent, or Firm*—Drinker Biddle & Reath LLP

(57) ABSTRACT

The invention relates to the use of PVD technique for the application of a low static friction and wear resistant coating consisting essentially of titanium nitride or a diamond-like carbon—DLC, with or without an addition of tungsten carbide, on a stainless steel, in one and the same operation as the surface hardening of the stainless steel. In this way, in one single operation, a low static friction is obtained on a very hard and wear resistant surface. Moreover, the dimensions of the work-piece are maintained unaltered, which makes the invention very useful in the production of, e.g., cam followers, cylinder tubes and piston rods for shock absorbers. The used stainless steel has the following composition (in weight %): carbon max about 0.1; nitrogen max about 0.1; copper from about 0.5 to about 4; chromium from about 10 to about 14; molybdenum from about 0.5 to about 6; nickel from about 7 to about 11; cobalt 0 to about 9; tantalum max about 0.1; niobium max about 0.1; vanadium max 0.1; tungsten max about 0.1; aluminum from about 0.05 to about 0.6; titanium from about 0.4 to about 1.4; silicon max about 0.7; manganese max about 1.0; iron balance, and normally occurring usual steelmaking additions and impurities.

6 Claims, No Drawings

METHOD FOR MANUFACTURING SURFACE HARDENED STAINLESS STEEL WITH IMPROVED WEAR RESISTANCE AND LOW STATIC FRICTION PROPERTIES

FIELD OF THE INVENTION

The present invention relates to a surface hardened stainless steel with a low static friction and with improved wear resistance. Moreover, it relates to a PVD treatment of the surface of said stainless steel, in which a surface hardening is accomplished simultaneously with said PVD treatment. The invention has many applications in, e.g., mechanical industry, automotive industry, motorcycle industry, bicycle industry, shock absorber manufacturing and in items for combustion engines and hydraulic systems.

BACKGROUND OF THE INVENTION

Normally, stainless steel alloys are softer than other steel materials, Therefore, they are frequently submitted to a hardening treatment, which basically may be a bulk treatment or a surface treatment. The bulk treatment is intended to harden the steel material homogenously, such as a plate or a wire, throughout the entire cross-section of the material, while the surface treatment is intended to harden only the surface of the component, leaving the substrate substantially unaffected.

For instance, U.S. Pat. No. 5,632,826 (&WO-A-95/09930), which is hereby included in its entirety into the disclosure of the present application by this reference, discloses a precipitation hardened stainless steel in which the strengthening is based on the precipitation of particles throughout the material. The strengthening particles have a quasi-crystalline structure, said structure being essentially obtained at aging times up to about 1000 hours and tempering treatments up to about 650° C. This strengthening involves an increase in tensile strength of at least 200 MPa.

Other processes for precipitation hardening stainless steel and/or components made of said steel are disclosed in WO-A-93/07303, WO-A-01/36699 and WO-A-01/14601, which hereby are all incorporated into the disclosure of the present application by this reference. For example, according to WO-A-01/36699, the production of the material prior to aging/hardening shall be such that the item be subjected to cold forming to a degree of deformation sufficient for obtaining a martensite content of at least 50% preferably at least 70%.

Instead of a hardening treatment affecting the steel throughout and homogenously, in many applications the stainless steel component is provided with a hardened surface, often referred to as "case hardening." The concept of case hardening is to transform a relatively thin layer of material at the surface of the part by enrichment of carbon or other ingredients, in order to make the surface harder than the substrate, the substrate being the bulk of the steel that remains unaffected by the surface modification.

Stainless steels are often case hardened by carburization. That is a process by which carbon atoms are diffused in solution into the surface of the component. Known case hardening processes are performed at high temperatures. Carburization processes performed at temperatures of about 540° C. or somewhat higher (for stainless steel alloys). However, such temperature processes can promote the formation of carbides in the hardened surface.

Steel tools, wear parts and parts in general with high demands on strength and/or toughness and wear resistance, are often coated to increase their service life and to improve the operational conditions. Known procedures such as CVD or PVD are useful for coating the different parts. The layers used are hard layers which usually are formed by nitrides, carbides or carbonitrides of titanium or hafnium or zirconium or their alloys. The variety of use of primarily coated tools are mentioned in the following publications: "Proceedings of the 13$^{th}$ Plansee-Seminar," Plansee, May 1993; and "Proceedings of the 20$^{th}$ International Conference on Metallurgical Coatings," San Diego, April 1993. Moreover, for forming tools, these hard coatings also achieve a reduction in the static friction.

In many mechanical applications, not only the hardness but also the static friction, as indicated above, of the steel surface is a known problem. Even if lubrication is made, the static friction may cause considerable friction loss, especially in cases where a reciprocal movement is present. Examples of such applications are shock absorbers for vehicles, hydraulic systems in the process industry, and internal items of combustion engines, such as cam followers. At high-frequency motion changes, the static friction may cause a local temperature increase on sealing metal surfaces in shock absorbers, which leads to deteriorated performance and risks of leakage of hydraulic oil.

In order to decrease the static friction, exposed surfaces are usually coated with some form of layer with better properties than the under-lying steel substrate. Besides giving a lower friction, one desired property of said layer is to protect against mechanical wear. Therefore, the applied layer should be as hard as possible. In hydraulic steering control equipment in process industry, a high static friction may cause a motion resistance that deteriorates the precision of the hydraulic component. Combustion engines constitute another application, where one endeavors to minimize that static friction. For instance, one critical component is the cam follower for inlet and outlet valves. The surface on which the follower acts is exposed to a very high local load, that may result in serious wear problems.

One conventional way of lowering the static friction and to increase the hardness, is to prepare a very smooth surface and then to apply hard chromium plating on this surface. The hardness level thereby achieved for low alloy wrought steel amounts to about 100 Hv. In order to support the layer, a surface hardening is often made before the hard chromium plating. The process is relatively complicated and involves several positions of the work-piece due to the dimension alterations it suffers during the hardening.

In U.S. Pat. No. 5,830,531 a method is disclosed for coating tools with a hardening and friction-reducing surface layer composition. First, the tool is coated in a vacuum process, such as a PVD procedure, with a first hard coating lying directly on the tool material, and then with a superimposed exterior friction-reducing layer over the hard coating. The grain size of the hard and friction-reducing layers has a linear average width of less than 1 μm, whereby excellent hardnesses and long tool lives are attained. However, in order to achieve the desired hardness, the steel first has to be submitted to a hardening treatment before the coating. The necessity of two treatments make the production more costly.

In U.S. Pat. No. 5,707,748 a method is disclosed which is very similar to the method disclosed in U.S. Pat. No. 5,830,531. The disclosures of these two U.S. patents are incorporated into their entirety into the present disclosure by this reference.

In WO-A-99/55929 a method is described for increasing the resistance to wear of a tool or machine component.

According to this patent document, a layered system is provided which is especially designed for tools or machine components that are operated in conditions of insufficient lubrication or dry-running. A treated work-piece consists of a base body or substrate of steel and a hard material layer system next to the substrate, supplemented by a metal layer and finally a sliding layer system, whereby the latter is preferably made of carbide, especially tungsten carbide or chromium carbide, and a dispersed carbon. Although good hardness values and low static friction are achieved, the "composite" system of several layers is complicated, time-consuming and expensive to produce.

Further, in WO-A-01/79585 a DLC (Diamond-Like Carbon) layer system is disclosed for producing a layer system for protection against wear, and improve friction qualities or the like. Said layer system comprises an adhesive layer which is placed on a substrate, a transition layer which is placed on the adhesive layer and an outer layer which is made of diamond-like carbon. The adhesive layer comprises at least one element from the group consisting of the $4^{th}$, $5^{th}$ and $6^{th}$ subgroups and silicon. The transition layer consists of diamond-like carbon. The layer system has a hardness of at least 15 GPa, preferably at least 20 GPa, and an adhesive strength of at least 3 HF according to VDI 3824 sheet 4. Again, this prior art requires several layers, thereby becoming time-consuming and complicated.

Plasma nitriding is an alternative case-hardening process, which is carried out in a glow discharge in a nitrogen gas-containing mixture at a pressure of about 100 to about 1000 Pa (about 1 to about 10 mbar), and it is one of the used methods to treat stainless steel surfaces, thereby resulting in a nitrogen diffusion layer having high hardness and excellent wear resistance. Nitriding hardening is induced by the precipitation of nitrides in the surface layer. The plasma nitriding is the most recently developed surface hardening procedure and it has already been described in the state of the art. This process replaces traditional nitriding methods, such as gas nitriding and nitrocarburation (short-term gas nitriding, bath nitriding and tenifer (a salt-bath nitriding process sometimes called the "Tuffride process") treatment), since identical thermo-chemical conditions can be established in this process. Plasma nitriding achieves higher hardness and wear resistance, while creating lower distortion. Furthermore, plasma nitriding is very cost effective. This is due to the fact that subsequent machining, finishing and residue removal processes are frequently not required. Similarly, supplementary protective measures, such as burnishing, phosphatizing, etc., may not be necessary.

The plasma nitriding is performed in a vacuum furnace. Treatment temperatures in the range of about 400 to about 580° C. are employed, subject to the requirements of the process in question. Typical treatment temperatures are in the range of about 420 to about 500° C. Treatment times vary between about 10 minutes and about 70 hours, depending upon the component to be treated as well as desired structure and thickness of the layer(s) formed. The most commonly used process gases are ammonia, nitrogen, methane and hydrogen. Oxygen and carbon dioxide are used in the corrosion-protective step of post-oxidation. Besides the type of process gas used, pressure, temperature and time are the main parameters of the treatment process. By varying these parameters, the plasma nitriding process can be fine-tuned to achieve the exact, desired properties in any treated component.

Any iron-based material can be submitted to plasma nitriding. The process does not require the use of special types of nitriding steel. Moreover, the results attained by plasma nitriding can be reproduced with pinpoint accuracy. This is especially important in the manufacture of serial products. However, plasma nitriding does not significantly reduce the static friction.

OBJECTS AND SUMMARY OF THE INVENTION

It is a primary object of the present invention to obtain a low static friction and wear resistant stainless steel surface.

Another object of the present invention is to obtain a low static friction on a very hard and wear resistant stainless steel surface in a simple and cost effective way, with as few procedural steps as possible.

Still another object of the present invention is to produce components of sophisticated geometry of said stainless steel with a low static friction on a very hard and wear resistant surface.

These and other objects have in a surprising way been attained by providing in a use of a stainless steel of the following composition (in weight %):

| | |
|---|---|
| Carbon | max about 0.1 |
| Nitrogen | max about 0.1 |
| Copper | from about 0.5 to about 4 |
| Chromium | from about 10 to about 14 |
| Molybdenum | from 0.5 to about 6 |
| Nickel | from about 7 to about 11 |
| Cobalt | 0 to about 9 |
| Tantalum | max about 0.1 |
| Niobium | max about 0.1 |
| Vanadium | max about 0.1 |
| Tungsten | max about 0.1 |
| Aluminum | from about 0.05 to about 0.6 |
| Titanium | from about 0.4 to about 1.4 |
| Silicon | max 0.7 |
| Manganese | max 1.0 |
| Iron | balance |

and normally occurring usual steelmaking additions and impurities having a hardened surface, the improvement comprising using said stainless steel with a low static friction and wear-resistant coating applied in the same operation as the surface hardening.

DETAILED DESCRIPTION OF THE INVENTION

Thus, the present invention relates to methods of application of a low static friction coating on a specific class of stainless steels. Moreover, this low static friction coating also results in a very hard and wear resistant surface. The coating is applied according to the well known PVD ("Physical Vapor Deposition") technique, in accordance with the state of the art referred to above. The steel has turned out to possess the surprising property of obtaining a considerable inner hardness increase when the coating is applied, whereby the necessary hard and carrying surface layer is created to carry the hard and low-friction top coating. Since the PVD operation is performed at a relatively low temperature, the dimensions of the work-piece are maintained, without any distortions. The utilization of the PVD technique on some special stainless steel alloys brings about a number of advantages for the production of, e.g., cylinder tubes and piston rods for shock absorbers, pistons for hydraulic guide means, and cam followers for combustion engines.

For illustrative but non-limiting purposes, a preferred embodiment of the invention will now be described in more detail.

Before any surface modifications, a suitable group of stainless steels for the purposes of the present invention was selected. It has the following composition ranges (in weight %):

| | |
|---|---|
| Carbon | max about 0.1 |
| Nitrogen | max about 0.1 |
| Copper | from about 0.5 to about 4 |
| Chromium | from about 10 to about 14 |
| Molybdenum | from 0.5 to about 6 |
| Nickel | from about 7 to about 11 |
| Cobalt | 0 to about 9 |
| Tantalum | max about 0.1 |
| Niobium | max about 0.1 |
| Vanadium | max about 0.1 |
| Tungsten | max about 0.1 |
| Aluminum | from about 0.05 to about 0.6 |
| Titanium | from about 0.4 to about 1.4 |
| Silicon | max 0.7 |
| Manganese | max 1.0 |
| Iron | balance |

and normally occurring usual steelmaking additions and impurities.

This stainless steel contains quasi-crystalline particles in a martensitic microstructure as a result of a precipitation hardening, as described in the above mentioned prior art references U.S. Pat. No. 5,632,826, WO-A-93/07303, WO-A-01/14601 and WO-A-01/36699.

In order to bring about a surface treatment according to the present invention, a specific precipitation hardened stainless steel (named "1RK91") was chosen having the following composition (in weight %):

| | |
|---|---|
| C + N | max about 0.05 |
| Cr | 12.00 |
| Mn | 0.30 |
| Ni | 9.00 |
| Mo | 4.00 |
| Ti | 0.90 |
| Al | 0.30 |
| Si | 0.15 |
| Cu | 2.00 |
| Fe | Balance |

On this steel, a low static friction coating is applied, said coating consisting essentially of titanium nitride or diamond-like carbon—DLC—which is applied by PVD technique. In an optional embodiment, the coating consists essentially of diamond-like carbon with the addition of tungsten carbide. This includes that the metal piece is exposed to a temperature between about 450 and about 500° C. during a couple of hours. In the same temperature region, and after determined intervals, a hardening of the steel takes place, whereby a hardness in the magnitude of 650 Hv is attained. In this way, an excellent support for the coating is obtained in the same operation. Thanks to the relatively low treatment temperature, the work-piece maintains its shape very well, which results in a considerably simplified working process. At the same time, in spite of a thinner layer, the thickness of which is in the order of 6 μm, a superior wear resistance is obtained in comparison to conventional 25 μm thick hard chromium layers on a hardened surface. Thus, the great advantage of the present invention is that the application of the low static friction and wear resistant coating and the necessary surface hardening are brought about in one and the same operation.

Another significant advantage of the present invention is when the work-piece is in tube-shape for the manufacturing of tube-shaped items. Thanks to an excellent cold-workability of the stainless steel according to the invention, tubular products are readily produced. Costly long-hole drilling operations otherwise required for commonly available bar shaped products are thus eliminated. Other embodiments of the invention are strip shaped.

It should be note that when extremely hard and wear resistant surfaces are required, e.g., in some engine components, it would be a feasible modification of the present invention to include a plasma nitrided layer according to the above related technique, which is also disclosed in the Swedish Patent Application No. 0202107-9 between the substrate and the PVD coating according to the present invention. It would cause no problem to submit the stainless steel to temperatures in the range of about 450 to about 500° C. twice, since it will easily resist this temperature without showing softening tendencies.

The principles, preferred embodiments and modes of operation of the present invention have been described in the foregoing specification. The invention which is intended to be protected herein, however, is not to be construed as limited to the particular forms disclosed, since these are to be regarded as illustrative rather than restrictive. Variations and changes may be made by those skilled in the art without departing from the spirit of the invention.

The invention claimed is:

1. A method of manufacturing a steel product, the method comprising:

surface hardening a steel workpiece at a temperature region between about 450° C. and 500° C.; and simultaneously, while at the temperature region between about 450° C. and 500° C., applying a low static friction and wear-resistant coating by a physical vapor technique on a surface of the steel workpiece, wherein the coating consists essentially of diamond-like carbon with addition of tungsten carbide, wherein the steel workpiece is a stainless steel of the following composition (in weight %):

| | |
|---|---|
| Carbon | max about 0.1 |
| Nitrogen | max about 0.1 |
| Copper | from about 0.5 to about 4 |
| Chromium | from about 10 to about 14 |
| Molybdenum | from 0.5 to about 6 |
| Nickel | from about 7 to about 11 |
| Cobalt | 0 to about 9 |
| Tantalum | max about 0.1 |
| Niobium | max about 0.1 |
| Vanadium | max about 0.1 |
| Tungsten | max about 0.1 |
| Aluminum | from about 0.05 to about 0.6 |
| Titanium | from about 0.4 to about 1.4 |
| Silicon | max 0.7 |
| Manganese | max 1.0 |
| Iron | balance. |

2. The method of claim 1, comprising precipitation hardening the steel workpiece prior to simultaneous coating and surface hardening.

3. The method of claim 2, wherein precipitation hardening results in formation of quasi-crystalline particles.

4. A method of manufacturing a steel product, the method comprising:

surface hardening a steel workpiece at a temperature region between about 450° C. and 500° C.; and simultaneously, while at the temperature region between about 450° C. and 500° C., applying a low static friction and wear-resistant coating by a physical vapor technique on a surface of the steel workpiece, wherein the coating consists essentially of titanium nitride, wherein the steel workpiece is a stainless steel of the following composition (in weight %):

| | |
|---|---|
| Carbon | max about 0.1 |
| Nitrogen | max about 0.1 |
| Copper | from about 0.5 to about 4 |
| Chromium | from about 10 to about 14 |
| Molybdenum | from 0.5 to about 6 |
| Nickel | from about 7 to about 11 |

-continued

| | |
|---|---|
| Cobalt | 0 to about 9 |
| Tantalum | max about 0.1 |
| Niobium | max about 0.1 |
| Vanadium | max about 0.1 |
| Tungsten | max about 0.1 |
| Aluminum | from about 0.05 to about 0.6 |
| Titanium | from about 0.4 to about 1.4 |
| Silicon | max 0.7 |
| Manganese | max 1.0 |
| Iron | balance. |

5. The method of claim 4, comprising precipitation hardening the steel workpiece prior to simultaneous coating and surface hardening.

6. The method of claim 5, wherein precipitation hardening results in formation of quasi-crystalline particles.

* * * * *